US007367326B2

(12) United States Patent
Shikama et al.

(10) Patent No.: US 7,367,326 B2
(45) Date of Patent: May 6, 2008

(54) FAILURE DIAGNOSIS APPARATUS FOR EVAPORATIVE FUEL PROCESSING SYSTEM

(75) Inventors: Mahito Shikama, Wako (JP); Koichi Yoshiki, Wako (JP); Takashi Yamaguchi, Wako (JP); Yosuke Kosaka, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 254 days.

(21) Appl. No.: 11/346,367

(22) Filed: Feb. 3, 2006

(65) Prior Publication Data

US 2006/0179928 A1 Aug. 17, 2006

(30) Foreign Application Priority Data

Feb. 15, 2005 (JP) ..... 2005-037042

(51) Int. Cl.
*F02M 33/04* (2006.01)
*F02M 33/02* (2006.01)

(52) U.S. Cl. ..... 123/520; 123/198 D

(58) Field of Classification Search ..... 123/520, 123/198 D, 519, 518, 516; 73/118.1, 119 A
See application file for complete search history.

(56) References Cited

U.S. PATENT DOCUMENTS 7,036,359 B2 * 5/2006 Hayakawa et al. ..... 73/118.1
2003/0015179 A1 * 1/2003 Kawano ..... 123/520
2005/0044942 A1 * 3/2005 Amano e al. ..... 73/118.1
2005/0229688 A1 * 10/2005 Miyahara et al. ..... 73/118.1

FOREIGN PATENT DOCUMENTS

JP 3199057 6/2001

* cited by examiner

*Primary Examiner*—Mahmoud Gimie
(74) *Attorney, Agent, or Firm*—Arent Fox LLP.

(57) ABSTRACT

A failure diagnosis apparatus for diagnosing a failure of an evaporative fuel processing system. The system includes a fuel tank, a canister having adsorbent for adsorbing evaporative fuel generated in the fuel tank, an air passage connected to the canister for communicating the canister with the atmosphere, a first passage for connecting the canister and the fuel tank, a second passage for connecting the canister and an intake system of an internal combustion engine, and a purge control valve provided in the second passage. A pressure in the evaporative fuel processing system is detected. An opening of the purge control valve is controlled by changing a duty ratio of a drive signal which drives the purge control valve. First and second filterings of the detected pressure are performed. A second passing frequency band of the second filtering is narrower than a first passing frequency band of the first filtering. A flow rate abnormality of a purge gas flowing in the second passage is determined based on the filtered pressures.

18 Claims, 8 Drawing Sheets

FAILURE DIAGNOSIS APPARATUS FOR EVAPORATIVE FUEL PROCESSING SYSTEM

BACKGROUND OF THE INVENTION

1. Field of the Invention

The present invention relates to a failure diagnosis apparatus for diagnosing the failure of an evaporative fuel processing system which temporarily stores evaporative fuel generated in a fuel tank and supplies the stored evaporative fuel to an internal combustion engine.

2. Description of the Related Art

A failure diagnosis apparatus for an evaporative fuel processing system is shown in Japanese Patent Publication No. 3199057, for example. According to this apparatus, a negative pressure is introduced into the evaporative fuel processing system through a purge control valve from the intake pipe of an internal combustion engine. When the pressure in the evaporative fuel processing system does not reach a predetermined negative pressure within a predetermined time period, the purge control valve is determined to be abnormal.

In the above-described conventional failure diagnosis apparatus, it is necessary to close a valve provided in the air passage which introduces air into the evaporative fuel processing system, in order to negatively pressurize the inside of the evaporative fuel processing system. Accordingly, the failure diagnosis cannot be performed when performing the ordinary evaporative fuel purge from the evaporative fuel processing system to the intake system of the engine. Therefore, if the failure diagnosis is performed at an appropriate frequency, the evaporative fuel stored in the evaporative fuel processing system may not be sufficiently purged. In other words, there is a case where the failure diagnosis cannot be performed at a sufficient frequency, when performing the purge of evaporative fuel at an appropriate frequency.

SUMMARY OF THE INVENTION

The present invention is made contemplating above-described point. Therefore, at least one object of the present invention is to provide a failure diagnosis apparatus which can perform a failure diagnosis of the evaporative fuel processing system while purging of the evaporative fuel, thereby securing a sufficient execution frequency of the failure diagnosis and performing sufficient purge of the evaporative fuel.

In view of the above, the present invention provides a failure diagnosis apparatus for diagnosing a failure within an evaporative fuel processing system which includes a fuel tank, a canister having adsorbent for adsorbing evaporative fuel generated in the fuel tank, an air passage connected to the canister for communicating the canister with the atmosphere, a first passage for connecting the canister and the fuel tank, a second passage for connecting the canister and an intake system of an internal combustion engine, and a purge control valve provided in the second passage. The failure diagnosis apparatus includes pressure detecting means, control means, first filtering means, second filtering means, and flow rate abnormality determining means. The pressure detecting means detects a pressure (PTANK) in the evaporative fuel processing system. The control means controls an opening of the purge control valve by changing a duty ratio (DOUTPGC) of a drive signal which drives the purge control valve. The first filtering means performs a first filtering of the pressure (PTANK) detected by the pressure detecting means. The second filtering means performs a second filtering of the pressure (PTANK) detected by the pressure detecting means. The second passing frequency band of the second filtering is narrower than the first passing frequency band of the first filtering. The flow rate abnormality determining means determines a flow rate abnormality of a purge gas flowing in the second passage, based on the filtered pressures outputted from the first and second filtering means.

It should be noted that the "flow rate abnormality of the purge gas" described above includes an open failure of the purge control valve.

With this configuration, the detected pressure in the evaporative fuel processing system is subjected to the two filtering processes which differ in passing frequency bands, and the flow rate abnormality of the purge gas is determined based on the filtered pressures. The opening of the purge control valve is controlled by the drive signal having a variable duty-ratio. Accordingly, the frequency component corresponding to the drive signal is contained in the pressure detected during execution of the evaporative fuel purging, if the purge control valve is normal. Therefore, by appropriately setting the passing bands of the first and second filtering, it is possible to determine whether the frequency component corresponding to the drive signal is contained or not from the pressure detected during execution of the evaporative fuel purge. Hence, it can be accurately determined whether an abnormality has occurred, according to whether the frequency component corresponding to the drive signal is contained or not. As a result, sufficient execution frequency of the failure diagnosis can be secured and the evaporative fuel purge can be sufficiently performed.

Preferably, the flow rate abnormality determining means includes open failure determining means for determining an open failure of the purge control valve based on changes in the pressure (PTANK) detected by the pressure detecting means immediately after the engine starts.

With this configuration, the open failure of the purge control valve is determined based on changes in the pressure detected immediately after starting of the engine. The purge control valve is closed (i.e., the valve opening control signal is not outputted) immediately after starting of the engine. Accordingly, if the pressure in the evaporative fuel processing system changes immediately after starting of the engine, then the purge control valve is determined to be unclosed, i.e., it is determined that the open failure has occurred. Therefore, the open failure of the purge control valve can be accurately determined in a short time period.

Preferably, the flow rate abnormality determining means includes open failure determining means for determining an open failure of the purge control valve based on changes in the pressure (PTANK) detected by the pressure detecting means immediately after the engine stops.

With this configuration, the open failure of the purge control valve is determined based on changes in the pressure detected immediately after stoppage of the engine. The valve opening control signal is not outputted also immediately after stoppage of the engine, similarly as immediately after starting of the engine. Accordingly, if the pressure in the evaporative fuel processing system changes immediately after stoppage of the engine, then the purge control valve is determined to be unclosed, i.e., it is determined that the open failure has occurred. Therefore, the open failure of the purge control valve can be accurately determined in a short time period.

Preferably, the first filtering is a first low-pass filtering and the second filtering is a combination of a band-stop filtering and a second low-pass filtering. The band-stop filtering eliminates a frequency component that corresponds to a frequency of the drive signal of the purge control valve.

Preferably, the flow rate abnormality determining means determines based on the filtered pressures that the flow rate of the purge is normal if a pulsation component having a period which is substantially equal to a period (TD) of the drive signal of the purge control valve is detected in the pressure detected by the pressure detecting means.

Preferably, the engine is provided with a turbocharger, and the evaporative fuel processing system includes a jet pump for supplying of evaporative fuel to the intake system during turbocharging.

DETAILED DESCRIPTION OF THE PREFERRED EMBODIMENTS

Preferred embodiments of the present invention will be now described with reference to the drawings.

Figure 1:
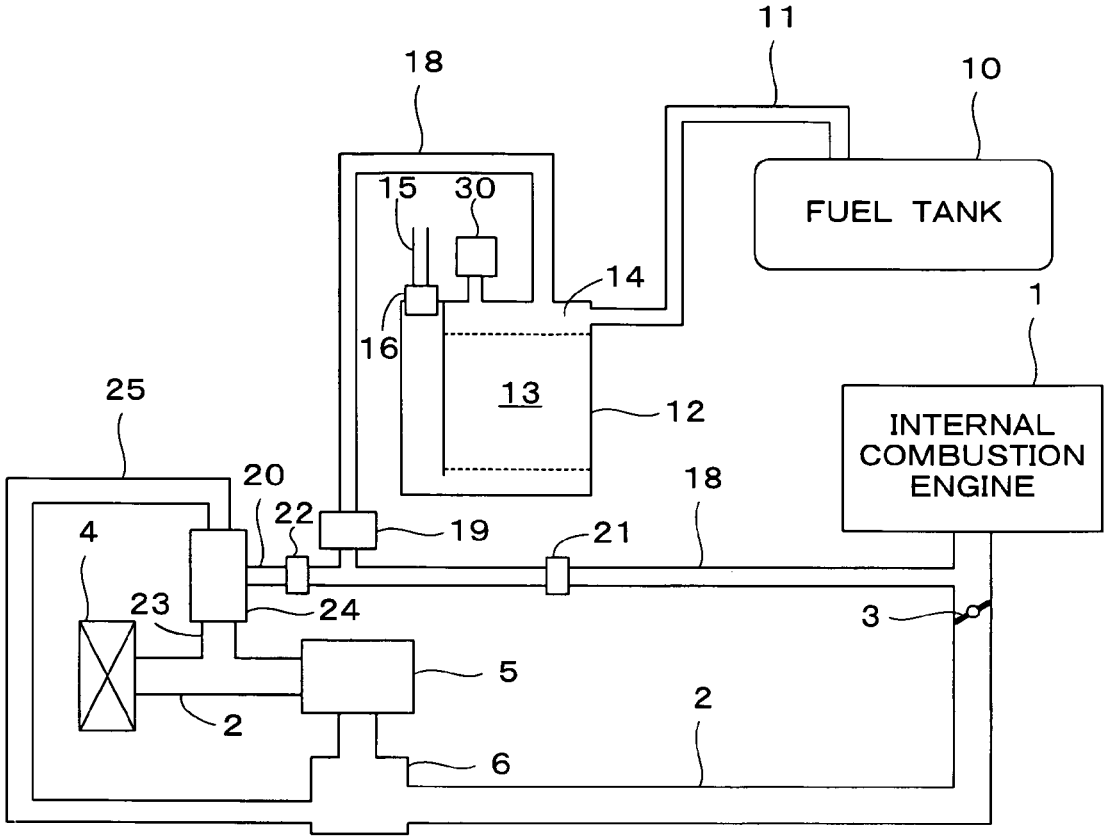
FIG. 1 is a schematic diagram showing a configuration of an evaporative fuel processing system and an intake air system of an internal combustion engine according to an embodiment of the present invention.

FIG. 1 is a schematic diagram showing a configuration of an evaporative fuel processing system and an intake air system of an internal combustion engine according to one embodiment of the present invention. The internal combustion engine (hereinafter referred to as "engine") 1 has an intake pipe 2, and the intake pipe 2 is provided with an air cleaner 4, a turbocharger 5, an intercooler 6, and a throttle valve 3 in this order from the upstream side. The turbocharger 5 has a turbine rotationally driven by the exhaust gas energy, and a compressor which is rotated by the turbine and pressurizes the intake air. The turbocharger 5 discharges pressurized air downstream in the intake pipe 2.

A fuel tank 10 is connected to a canister 12 through a charge passage 11, and the canister 12 is connected through a first purge passage 18 to the intake pipe 2 at the downstream side of the throttle valve 3.

Figure 3:
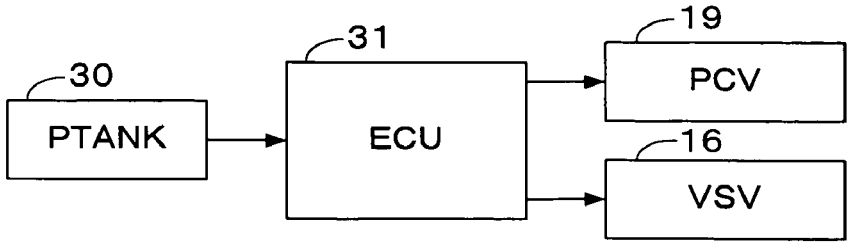
FIG. 3 is a schematic diagram showing a configuration of a control system of the evaporative fuel processing system.

The canister 12 has an adsorbent maintenance section 13 for containing activated carbon as an adsorbent for adsorbing evaporative fuel in the fuel tank 10, and a connection room 14 in which the charge passage 11 and the purge passage 18 are connected. The connection room 14 is provided with a pressure sensor 30 for detecting a pressure in the evaporative fuel processing system. The detection signal of the pressure sensor 30 is supplied to the electronic control unit (hereinafter referred to as "ECU") 31, as shown in FIG. 3. The pressure detected by the pressure sensor 30 does not always indicate the pressure in the fuel tank 10. In the steady state, the pressure detected by the pressure sensor 30 becomes equal to the pressure in the fuel tank 10. Therefore, the detected pressure by the pressure sensor 30 is hereinafter referred to as "tank pressure PTANK".

An air passage 15 communicating with the atmosphere is connected to the canister 12, and a vent shut valve 16 is provided at a connecting portion of the air passage 15 and the canister 12. The vent shut valve 16 is an electromagnetic valve connected to the ECU 31, as shown in FIG. 3, and is controlled to be opened or closed by the ECU 31. The vent shut valve 16 is opened during execution of refueling or the evaporative fuel purge. The vent shut valve 16 is a normally open type solenoid valve which remains open when no drive signal is supplied thereto.

The first purge passage 18 is provided with a purge control valve 19. The purge control valve 19 is a solenoid valve constituted so that a flow rate could be continuously controlled by changing the ON-OFF duty ratio of the drive signal. The operation of the purge control valve is controlled by the ECU 31.

The first purge passage 18 branches off to a passage 20 at a portion downstream of the purge control valve 19, and the passage 20 is connected by the jet pump 24 and the passage 23 to a portion of the intake pipe 2 upstream of the turbocharger 5. That is, a second purge passage is formed by the passages 20 and 23. The air pressurized by the turbocharger 5 is supplied to the jet pump 24 through the pressurized air supply passage 25.

Figure 2:
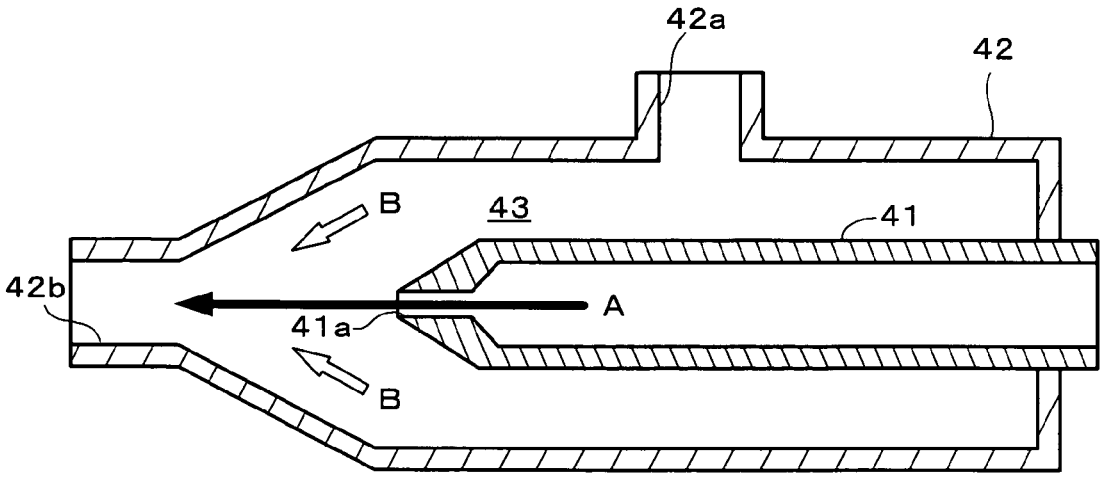
FIG. 2 is a sectional view of the jet pump shown in FIG. 1.

FIG. 2 is a sectional view showing a configuration of the jet pump 24. The jet pump 24 includes a cylindrical nozzle 41 and a casing 42. The cylindrical nozzle 41 is connected to the pressurized air supply passage 25, and discharges the pressurized air. The casing 42 surrounds the nozzle 41 with a space 43 therebetween. The nozzle 41 has a discharge aperture 41*a* through which the pressurized air is discharged. The casing 42 has an intake port 42*a* connected to the passage 20, and an exhaust port 42*b* connected to the passage 23.

When the air, which is pressurized by the turbocharger 5, is discharged from the nozzle 41 of the jet pump 24 (refer to the arrow A), a flow (refer to the arrow B) from the intake port 42*a* to the exhaust port 42*b* is generated by the discharging air flow, due to the viscosity of the discharging air, so that a negative pressure is generated. Accordingly, without the pressurized air flowing into the passage 20, an air-fuel mixture (hereinafter refer to as "purge gas") containing evaporative fuel is attracted from the passage 20 through the intake port 42*a*, and emitted with the pressurized air to the passage 23 through the exhaust port 42*b*. The purge gas emitted from the jet pump 24 is supplied to the upstream side of the turbocharger 5 of the intake pipe 2. Consequently, the evaporative fuel can be purged from the canister 12 to the intake pipe 2 also during the turbocharger operation.

A first check valve 21 is provided downstream of the branching-off portion where the first purge passage 18 branches off to the passage 20. Further, the passage 20 is provided with a second check valve 22. The first and second check valves 21 and 22 open when a pressure difference between the pressure at the upstream side of each valve and the pressure at the downstream side of each valve exceeds a predetermined pressure (e.g., 0.67 kPa (5 mmHg)). The first check valve 21 opens when the intake pressure PBA at the downstream side of the throttle valve 3 is a negative pressure (a pressure which is lower than the atmospheric pressure PA). When the turbocharger 5 starts to pressurize air, a negative pressure will be generated by the attraction power of the jet pump 24. Consequently, the second check valve 22 opens due to the negative pressure generated by the jet pump 24. For instance, the second check valve 22 opens when the intake pressure PBA becomes higher than a purge start pressure that is lower than the atmospheric pressure PA by about 6.7 kPa (50 mmHg). Therefore, while the turbocharger 5 is not operating, only the first check valve 21 opens and the evaporative fuel is supplied through the first purge passage 18 to the downstream side of the throttle valve 3 in the intake pipe 2. On the other hand, if the intake pressure PBA becomes higher than the atmospheric pressure PA during operation of the turbocharger 5, the first check valve 21 closes, and only the second check valve 22 opens. Consequently, the evaporative fuel is supplied through the passage 20, the jet pump 24, and the passage 23 to the upstream side of the turbocharger 5 in the intake pipe 2. When the turbocharger 5 is operating and the intake pressure PBA is between the purge start pressure and the atmospheric pressure PA, both of the check valves 21 and 22 open and the supply of the evaporative fuel through the first purge passage 18 and the jet pump 24 is performed.

The evaporative fuel processing system of one embodiment of the present invention includes the charge passage 11, the canister 12, the air passage 15, the vent shut valve 16, the first purge passage 18, the purge control valve 19, the passages 20 and 23 (the second purge passage), the first check valve 21, the second check valve 22, the jet pump 24, and the pressurized air supply passage 25.

If a large amount of evaporative fuel is generated upon refueling of the fuel tank 10, then the evaporative fuel is stored in the adsorbent of the canister 12. In a predetermined operating condition of the engine 1, then the duty control of the purge control valve 19 is performed, and a proper amount of evaporative fuel is supplied from the canister 12 to the intake pipe 2.

Further, in this embodiment, when purging in which evaporative fuel is supplied to the intake pipe 2 is performed, the ECU 31 determines the flow rate abnormality of the purge gas passing the purge control valve 19 and an open failure of the purge control valve 19, based on the tank pressure PTANK detected by the pressure sensor 30. The flow rate abnormality includes a close failure of the purge control valve 19, but does not include abnormality due to the open failure of the purge control valve 19 in this embodiment. The flow rate abnormality will be hereinafter referred to as "purge flow abnormality". The close failure is a failure that the purge control valve 19 is fixed to the closed state and does not open, and the open failure is a failure that the purge control valve 19 is fixed to the open state and does not close.

The ECU 31 shown in FIG. 3 is connected to various sensors (not shown), such as an engine rotational speed sensor, an intake pressure sensor, a throttle valve opening sensor, and an engine coolant temperature sensor, in addition to the pressure sensor 30. Operating conditions of the engine 1 are detected by the output signals of these sensors. The ECU 31 includes an input circuit, a central processing unit (hereinafter referred to as "CPU"), a memory circuit, and an output circuit. The input circuit has various functions, such as a function of shaping waveforms of the input signals from the various sensors, a function of correcting the voltage levels of the input signals to a predetermined level, and a function of converting analog signal values into digital signal values. The memory circuit stores operational programs to be executed by the CPU described above and stores the results of computation or the like by the CPU. The output circuit outputs driving signals to the purge control valve 19, the vent shut valve 16, the fuel injection valve (not shown) and the like.

A determination method of the purge flow abnormality in the present embodiment will now be described with reference to FIG. 4.

Figure 4A:
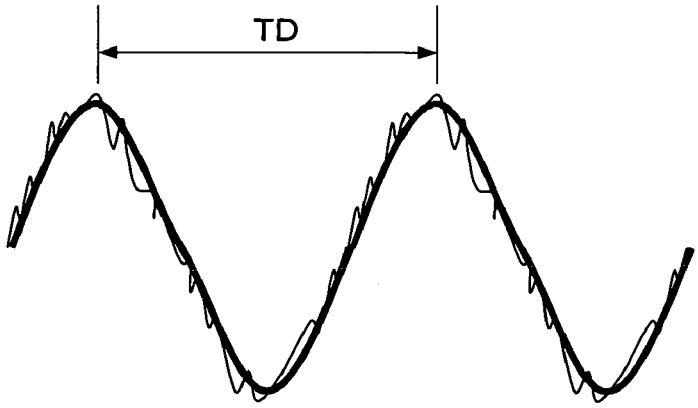
FIGS. 4A-4C are diagrams showing waveforms of an output signal of a pressure sensor for explaining failure diagnosis methods.

In this embodiment, a pulse signal having a period TD (e.g., 80 milliseconds) is supplied to the purge control valve 19 as the drive signal, and an opening of the purge control valve 19 is controlled by changing the duty ratio of the pulse signal. Therefore, when the purge control valve 19 is normal, an output waveform of the pressure sensor 30 (a waveform of the tank pressure PTANK) is, as shown in FIG. 4A, a waveform consisting of a component of the period TD and a noise component superimposed on the component of the period TD. By making the signal shown in FIG. 4A subjected to a low-pass filtering (hereinafter referred to as "first low-pass filtering") which removes the noise component, a first averaged signal SA1 shown in FIG. 4C is obtained.

Figure 4B:
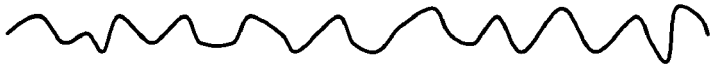
Figure 4C:
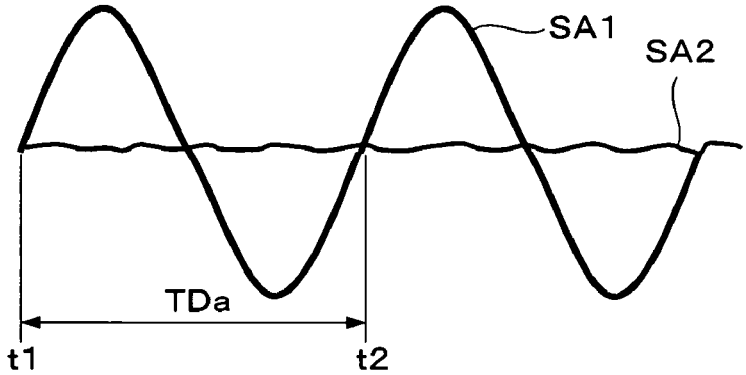

FIG. 4B shows a waveform of the signal obtained by making the signal shown in FIG. 4A subjected to a band-stop filtering which prevents the component corresponding to the signal of the period TD from passing. By making the signal shown in FIG. 4B subjected to another low-pass filtering (hereinafter referred to as "second low-pass filtering"), a second averaged signal SA2 shown in FIG. 4C is obtained. The cutoff frequency fC2 of the second low-pass filtering is set to be lower than the cutoff frequency fC1 of the first low-pass filtering.

The first averaged signal SA1 and the second averaged signal SA2 cross each other at times t1 and t2. If the time period TDa from time t1 to time t2 is substantially equal to the period TD, the purge control valve 19 can be determined to be normal. On the other hand, if the time period TDa is changing or not within the vicinity of the period TD, it can be determined that the purge flow abnormality is present.

Further in this embodiment, the open failure of the purge control valve 19 is determined by the method described below.

The purge control valve 19 is immediately closed after starting of the engine 1. Therefore, if the purge control valve 19 is normally closed, the tank pressure PTANK becomes substantially equal to the atmospheric pressure PA as shown by the solid line in FIG. 5A. On the other hand, if the open failure of the purge control valve 19 is present, the tank pressure PTANK decreases to a negative pressure PN lower than the atmospheric pressure PA since the negative pressure is immediately introduced to the evaporative fuel processing system through the first purge passage 18 immediately after starting of the engine 1. Therefore, when a reduction amount of the tank pressure PTANK immediately after starting of the engine 1 exceeds a predetermined determination amount (when the tank pressure PTANK becomes lower than a predetermined negative pressure), the presence of the open failure of the purge control valve 19 can be determined.

Figure 5A:
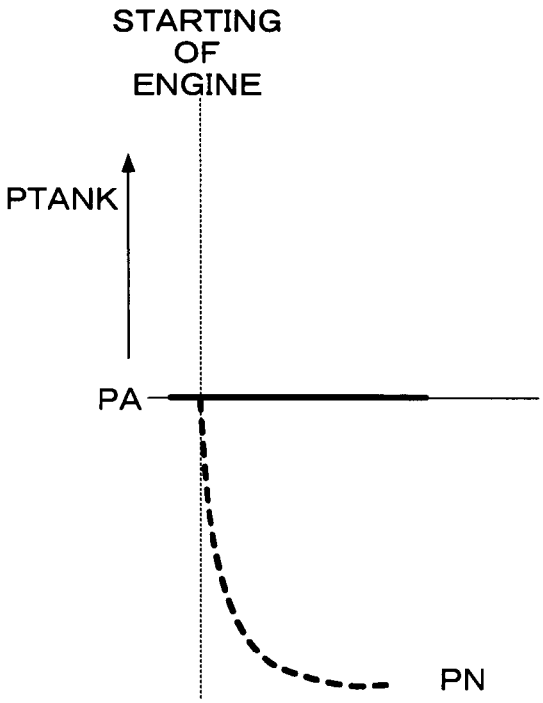
FIGS. 5A and 5B are time charts for illustrating a determination method of an open failure of a purge control valve.
Figure 5B:
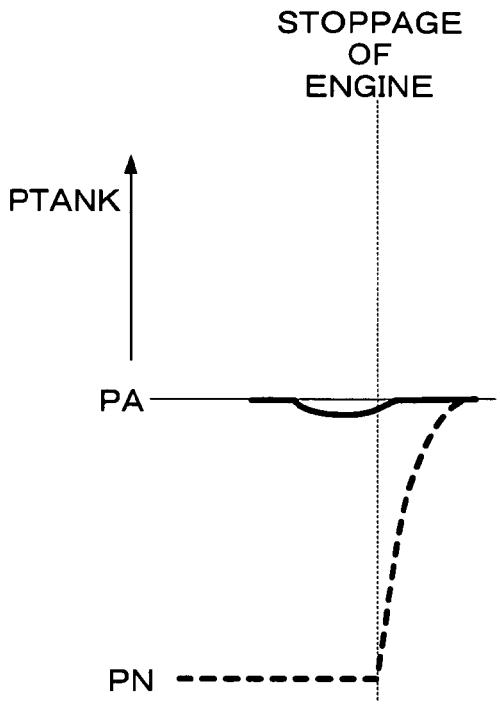

Further, the engine 1 is in the idling condition immediately before stoppage, and the purge control valve 19 is closed or is opened by a small opening degree. Therefore, if the purge control valve 19 is normal, a change in the tank pressure PTANK immediately after stoppage of the engine 1 is slight, as shown in FIG. 5B. On the other hand, if the open failure of the purge control valve 19 is present, the tank pressure PTANK increases from the negative pressure PN to the atmospheric pressure PA immediately after stoppage of the engine 1. Therefore, if an increase amount of the tank pressure PTANK immediately after stoppage of the engine 1 exceeds a predetermined determination amount, the presence of the open failure of the purge control valve 19 can be determined. It is noted that, in the example described below, the determination method which is shown in FIG. 5A and executed immediately after starting of the engine is adopted.

FIGS. 6 to 10 illustrate an exemplary embodiment of the failure diagnosis method of the purge control valve 19 executed by the CPU in the ECU 31. The processes shown in FIGS. 6 to 10 are executed at predetermined time intervals (e.g., 10 milliseconds).

Figure 6:
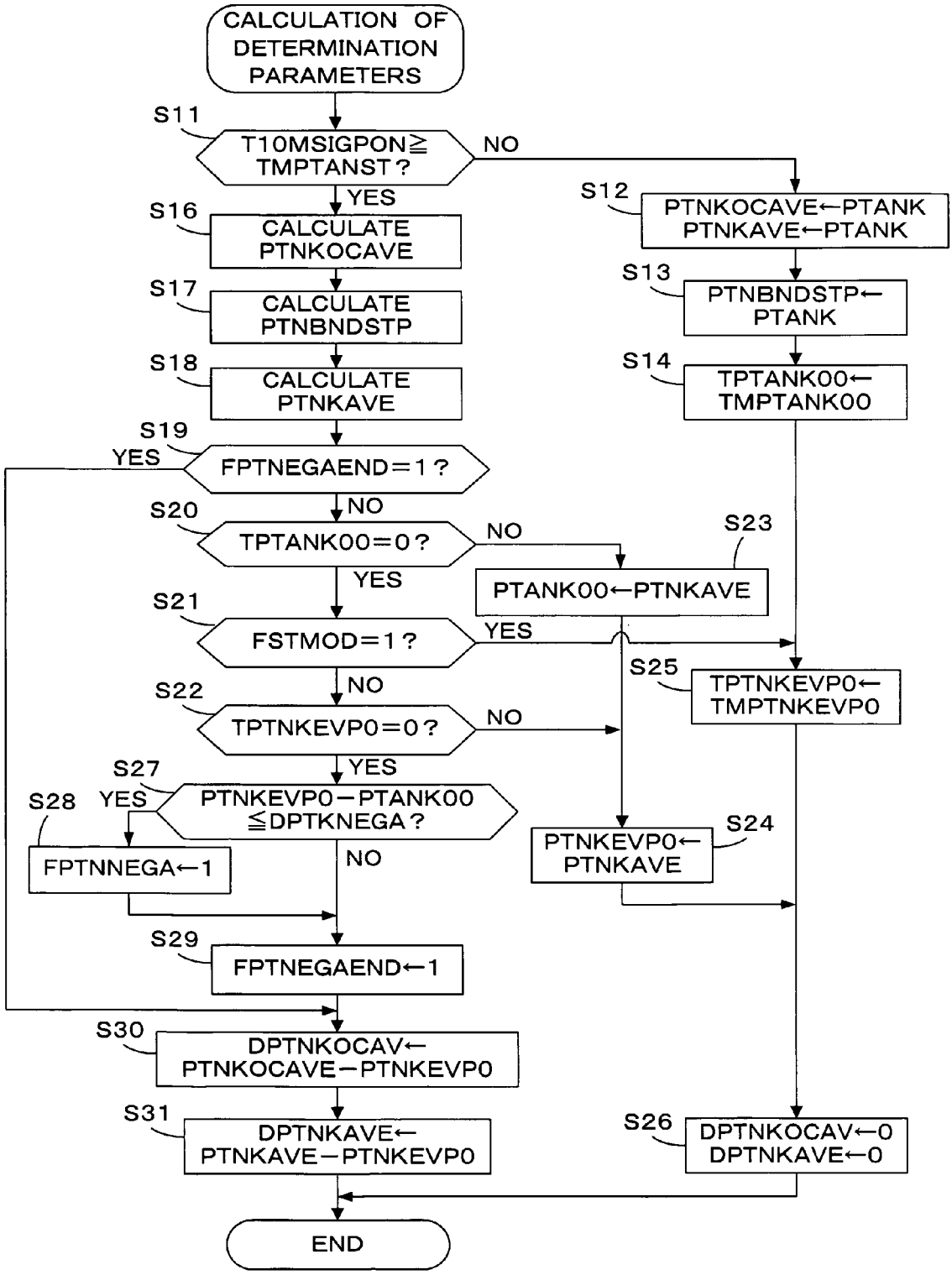
FIG. 6 is a flowchart of a process for calculating determination parameters (DPTNKOCAV, DPTNKAVE) used in the failure determination.

FIG. 6 is a flowchart illustrating a process for performing the first low-pass filtering, the band-stop filtering, and the second low-pass filtering, to calculate a first determination parameter DPTNKOCAV and a second determination parameter DPTNKAVE.

In step S11, it is determined whether or not a value of a timer T10MSIGPON for measuring an elapsed time period after the ignition switch is turned on is equal to or grater than a predetermined time period TMPTANST (e.g., 0.1 seconds). If the answer to step 11 is negative (NO), then a first low-pass filtered pressure PTNKOCAVE and a second low-pass filtered pressure PTANKAV calculated in steps S16 and S18 as described below, are both set to the present tank pressure PTANK (step S12). In step S13, a band-stop filtered pressure PTNBNDSTP calculated in the band-stop filtering (step S17) described below is set to the present tank pressure PTANK. In step S14, the downcount timer TPTANK00 referred to in step S20 is set to a predetermined time period TMPTANK00 (e.g., 0.1 seconds) and started.

Further, in step S25, a downcount timer TPTNKEVP0 referred to in step S22 is set to a predetermined time period TMPTNKEVP0(e.g., 10 seconds) and started. In step S26, both of a first determination parameter DPTNKOCAV and a second determination parameter DPTNKAVE are set to "0".

If the value of the timer T10 MSIGPON reaches the predetermined time period TMPTANST in step S11, then the process proceeds to step S16, in which the first low-pass filtered pressure PTNKOCAVE is calculated by the following expression (1).

$$PTNKOCAVE=CPTNKOCAVE\times PTANK+(1-CPTNKOCAVE)\times PTNKOCAVE \quad (1)$$

where CPTNKOCAVE is a first averaging coefficient which is set to a value between "0" and "1", and PTNKOCAVE on the right side is a preceding calculated value.

In step S17, the band-stop filtered pressure PTNBNDSTP (k) is calculated by the following expression (2). In the expression (2), "k" is a discrete time digitized with the execution period of this process, and (k) for indicating a present value is usually omitted.

$$PTNBNDSTP(k)=\sum_{i=0}^{2} BPTANK(i)\times PTANK(k-i)-\sum_{i=1}^{2} APTANK(i)\times PTNBNDSTP(k-i) \quad (2)$$

where BPTANK(i) (i=0, 1, 2) and APTANK(i) (i=1, 2) are filtering coefficients for realizing the band-stop filtering.

In step S18, the band-stop filtered pressure PTNBNDSTP is applied to the following expression (3) to calculate the second low-pass filtered pressure PTNKAVE.

$$PTNKAVE=CPTNKAVE\times PTNBNDSTP+(1-CPTNKAVE)\times PTNKAVE \quad (3)$$

where CPTNKAVE is a second averaging coefficient that is set to a value between "0" and "1", and PTNKAVE on the right side is a preceding calculated value. The second averaging coefficient CPTNKAVE is set to a value which is less than the first averaging coefficient CPTNKOCAVE (a value which makes the cutoff frequency lower).

In step S19, it is determined whether or not a negative-pressurization determination end flag FPTNEGAEND is "1". The negative-pressurization determination end flag FPTNEGAEND is set to "1" when the negative-pressurization determination performed immediately after starting engine 1 has ended (refer to step S29).

Since FPTNEGAEND is equal to "0" at first, the process proceeds to step S20, in which it is determined whether or not the value of the timer TPTANK00 started in step S14 is "0". Since TPTANK00 is greater than "0" at first, the process proceeds to step S23, in which a first reference pressure PTANK00 is set to the present second low-pass filtered pressure PTNKAVE. Next, a second reference pressure PTNKEVP0 is similarly set to the present second low-pass filtered pressure PTNKAVE (step S24), and the process proceeds to step S26 as described above.

If the answer to step S20 becomes affirmative (YES), then the process proceeds to step S21. The first reference pressure PTANK00 is set to the second low-pass filtered pressure PTNKAVE obtained at the time where a time period (TMPTANST+TMPTANK00) has elapsed from the time the ignition switch is turned on.

In step S21, it is determined whether or not a starting mode flag FSTMOD is "1". The starting mode flag FSTMOD is set to "1" during starting (cranking) of the engine 1. If FSTMOD is equal to "1", i.e., the engine 1 is starting, then the process proceeds to step S25 described above.

If FSTMOD is equal to "0" in step S21, i.e., the engine 1 is not at starting, then it is determined whether or not the value of the timer TPTNKEVP0 started in step S25 is "0" (step S22). Since TPTNKEVP0 is greater than "0" at first, the process proceeds to step S24 as described above, in which the second reference pressure PTNKEVP0 is updated.

If the answer to step S22 becomes affirmative (YES), the process proceeds to step S27. The second reference pressure PTNKEVP0 is set to the second low-pass filtered pressure PTNKAVE obtained at the time the predetermined time TMPTNKEVP0 has elapsed from the time of completion of starting of the engine 1.

In step S27, it is determined whether or not a value obtained by subtracting the first reference pressure PTANK00 from the second reference pressure PTNKEVP0 is equal to or lower than a negative determination threshold value DPTKNEGA (e.g., −0.53 kPa (−4 mmHg)). If the answer to step S27 is affirmative (YES), i.e., then the second low-pass filtered pressure PTNKAVE has decreased by a value which is equal to or grater than |DPTKNEGA| (refer to the change indicated by the dashed line shown in FIG. 5A) within the predetermined time period TMPTNKEVP0 after starting of the engine 1, a negative-pressurization flag FPTNNGA is set to "1" (step S28). The negative-pressurization flag FPTNNGA indicates that the tank pressure PTANK has been negatively-pressurized immediately after starting of the engine 1. Thereafter the process proceeds to step S29.

If the answer to step S27 is negative (NO), then the process immediately proceeds to step S29, in which the negative-pressurization determination end flag FPTNEGAEND is set to "1". After the negative-pressurization determination end flag FPTNEGAEND is set to "1", the process proceeds from step S19 to step S30. It is noted that, in the present embodiment, execution of the evaporative fuel purge is inhibited when the negative-pressurization determination end flag FPTNEGAEND is "0". Specifically, the duty ratio of the drive signal of the purge control valve 19 is maintained at 0%.

In step S30, the first determination parameter DPTNKOCAV is calculated by the following expression (4). In step S31, the second determination parameter DPTNKAVE is calculated by the following expression (5).

$$DPTNKOCAV=PTNKOCAVE-PTNKEVP0 \quad (4)$$

$$DPTNKAVE=PTNKAVE-PTNKEVP0 \quad (5)$$

Specifically, the first determination parameter DPTNKOCAV is obtained by converting the first low-pass filtered pressure PTNKOCAVE to a value whose reference value (zero point) is the second reference pressure PTNKEVP0, and the second determination parameter DPTNKAVE is obtained by converting the second low-pass filtered pressure PTNKAVE to a value whose reference value (zero point) is the second reference pressure PTNKEVP0.

Figure 7:
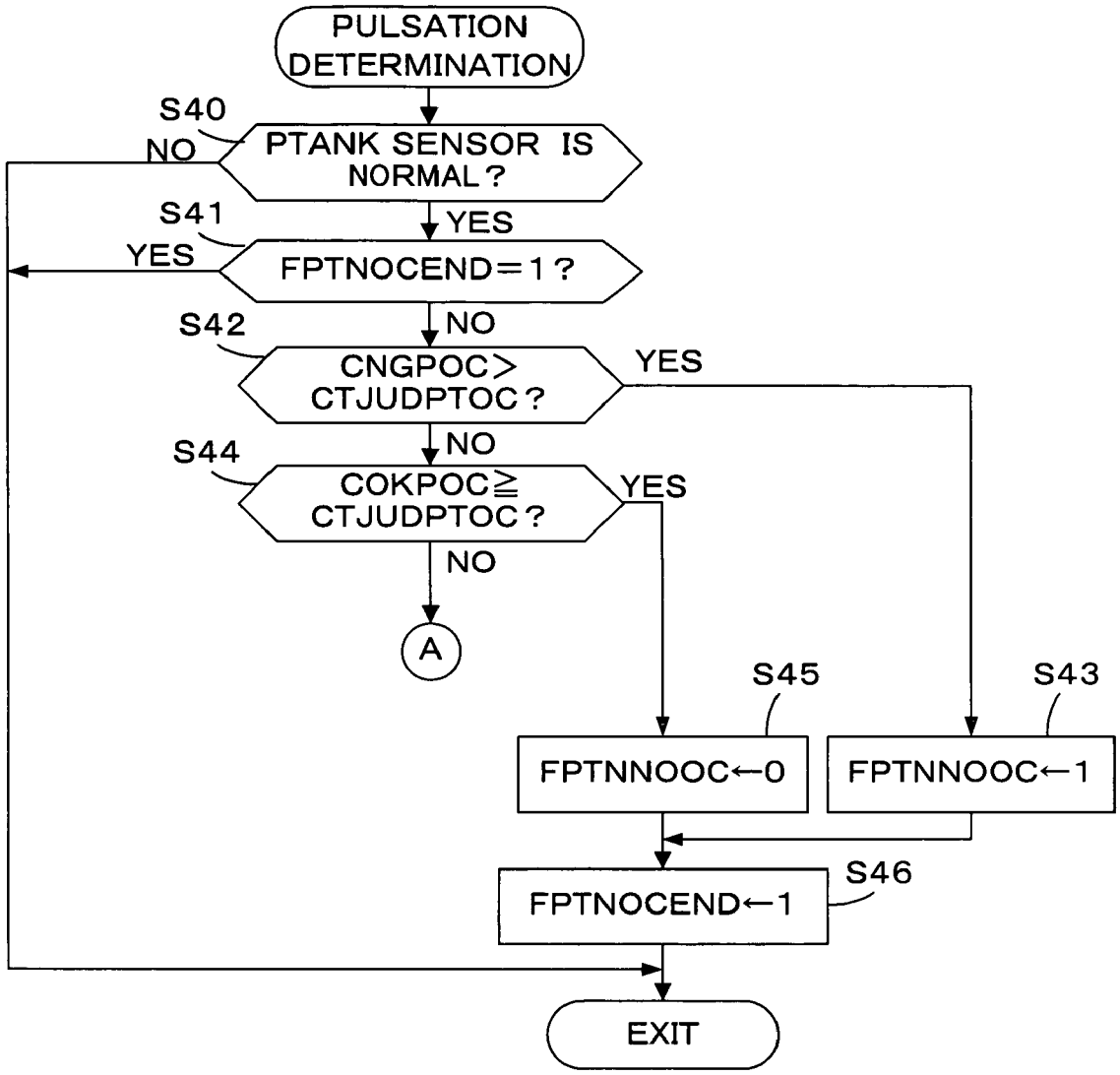
FIGS. 7 and 8 are flowcharts of a process for determining whether or not a pulsation component is present in the detected tank pressure (PTANK)
Figure 8:
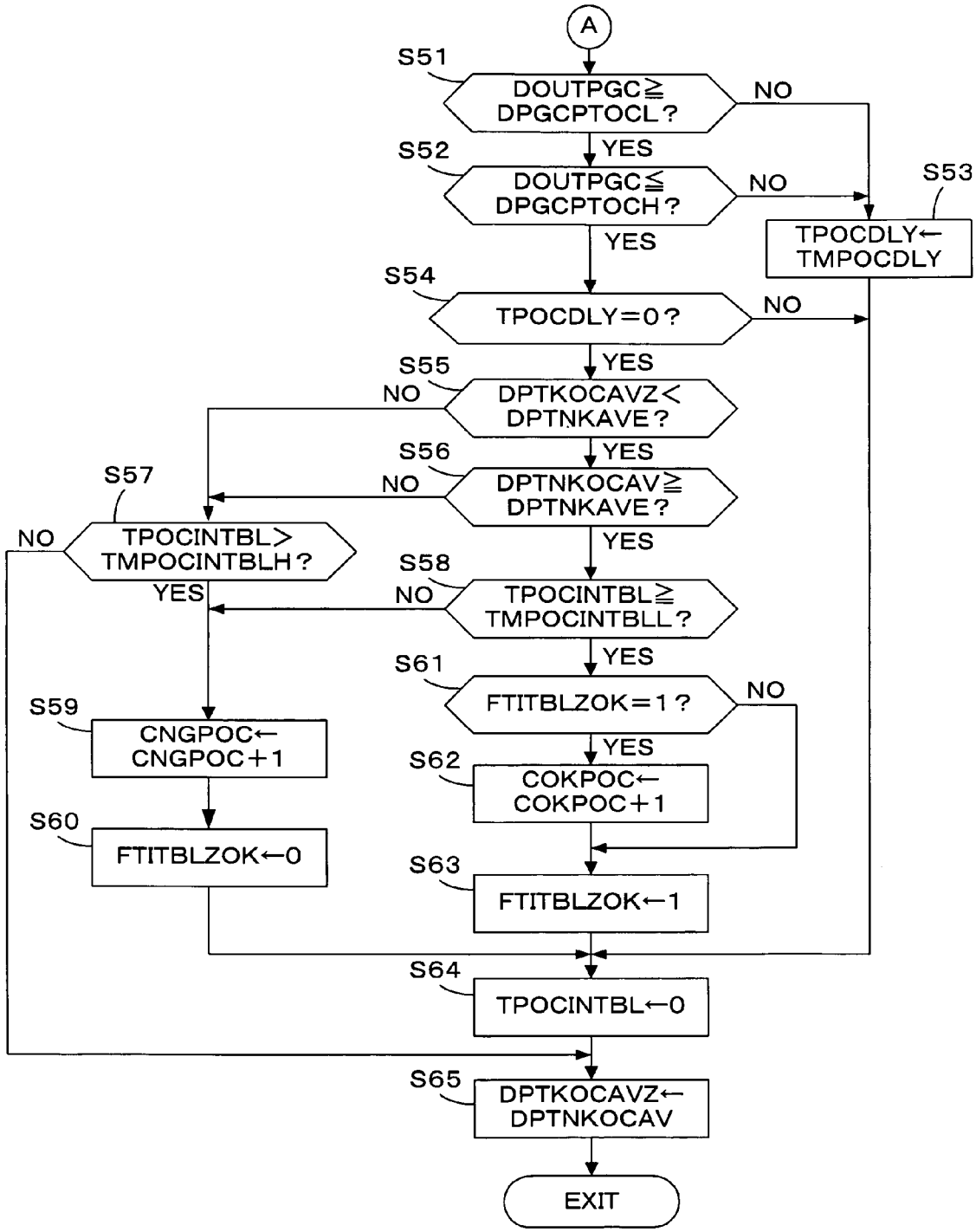

FIG. 7 and FIG. 8 are flowcharts illustrating a process of pulsation determination. In this process, it is determined whether or not a pulsation component, i.e., a changing component having the period TD of the drive signal, is contained in the detected tank pressure PTANK.

In step S40, it is determined whether or not the pressure sensor 30 is normal. Specifically, when a disconnection or a short-circuit (earth fault) is detected in a process not shown, the answer to step S40 becomes negative (NO). Otherwise, the answer to step S40 becomes affirmative (YES). If an abnormality of the pressure sensor 30 is detected, then the process immediately ends. If the pressure sensor 30 is normal, it is determined whether or not a pulsation determination end flag FPTNOCEND is "1" (step S41).

Since FPTNOCEND is equal to "0" at first, it is determined whether or not a value of an NG determination counter CNGPOC is grater than a pulsation determination threshold value CTJUDPTOC (e.g., 40)(step S42). Since the answer to step S42 is initially negative (NO), the process proceeds to step S44, to determine whether or not a value of an OK determination counter COKPOC is grater than the pulsation determination threshold value CTJUDPTOC. Since the answer to step S44 is also initially negative (NO), the process proceeds to step S51 (FIG. 8), to determine whether or not the duty ratio DOUTPGC of the drive signal supplied to the purge control valve 19 is equal to or grater than a predetermined lower limit value DPGCPTOCL (e.g., 10%). If the answer to step S51 is affirmative (YES), it is determined whether or not the duty-ratio DOUTPGC is equal to or less than a predetermined upper limit value DPGCPTOCH (e.g., 90%) (step S52).

If the answer to step S51 or S52 is negative (NO), which indicates that the duty ratio DOUTPGC is not within the range of the predetermined upper limit value and the predetermined lower limit value, then a downcount timer TPOCDLY is set to a predetermined time period TMPOCDLY (e.g., 3 seconds) and started (step S53). Thereafter, the process proceeds to step S64.

If the duty ratio DOUTPGC is less than the predetermined lower limit value DPGCPTOCL, then the valve opening time period is short. Accordingly, the pulsation component of the tank pressure PTANK may not be detected. If the duty ratio DOUTPGC is grater than the predetermined upper limit value DPGCPTOCH, then the valve opening time period is long. Accordingly, the pulsation component of the tank pressure PTANK may not be detected. Therefore, in such cases, the pulsation determination is discontinued to prevent incorrect determination.

If both of the answers to steps S51 and S52 are affirmative (YES), which indicates that the duty ratio DOUTPGC is within the range of the predetermined upper limit value and the predetermined lower limit value, then it is determined whether or not the value of the timer TPOCDLY started in step S53 is "0" (step S54). Since the answer to step S54 is initially negative (NO), the process immediately proceeds to step S64.

If the value of the timer TPOCDLY becomes "0", the process proceeds to step S55, to determine whether or not the preceding value DPTKOCAVZ of the first determination parameter DPTNKOCAV is less than the second determination parameter DPTNKAVE. If the answer to step S55 is affirmative (YES), then it is determined whether or not the first determination parameter DPTNKOCAV is grater than or equal to the second determination parameter DPTNKAVE (step S56). If both of the answers to steps S55 and S56 are affirmative (YES), that is, when the first determination parameter DPTNKOCAV changes from a value which is less than the second determination parameter DPTNKAVE to a value which is equal to or greater than the second determination parameter DPTNKAVE, then it is determined whether or not a value of a period measurement timer TPOCINTBL is equal to or grater than a predetermined lower limit value TMPOCINTBLL (e.g., 0.07 seconds) (step S58). The period measurement timer TPOCINTBL is an upcount timer which is reset to "0" in step S64. The value of this timer corresponds to the time period TDa as shown in FIG. 3 (*c*).

If TPOCINTBL is equal to or grater than TMPOCINTBLL in step S58, it is determined whether or not a preceding value normal flag FTITBLZOK is "1" (step S61). If the answer to step S61 is negative (NO), then the process immediately proceeds to step S63. If the preceding value normal flag FTITBLZOK is "1", then an OK determination counter COKPOC is incremented by "1" (step S62). In step S63, the preceding value normal flag FTITBLZOK is set to "1".

In step S64, the value of the period measurement timer TPOCINTBL is reset to "0". In step S65, the preceding value DPTKOCAVZ of the first determination parameter DPTNKOCAV is set to the first determination parameter DPTNKOCAV (present value). Thereafter, the process ends.

If the answer to step S58 is negative (NO), i.e., if the value of the period measurement timer TPOCINTBL is less than a predetermined lower limit value TMPOCINTBLL, this indicates that the measured period is too short. Therefore, the process proceeds to step S59, in which an NG determination counter CNGPOC is incremented by "1". In next step S60, the preceding value normal flag FTITBLZOK is set to "0". Thereafter, the process proceeds to step S64 as described above.

If the answer to step S55 or S56 is negative (NO), i.e., if the preceding value DPTKOCAVZ of the first determination parameter DPTNKOCAV is equal to or grater than the second determination parameter DPTNKAVE, or if the first determination parameter DPTNKOCAV is less than the second determination parameter DPTNKAVE, then it is determined whether or not the value of the period measurement timer TPOCINTBL is greater than a predetermined upper limit value TMPOCINTBLH (e.g., 0.09 seconds) (step S57). If the answer to step S57 is negative (NO), then the process immediately proceeds to step S65.

If the value of the period measurement timer TPOCINTBL is grater than the predetermined upper limit value TMPOCINTBLH in step S57, this indicates that the measured period is too long. Therefore, the process proceeds to step S59 as described above.

According to steps from S51 to S65, if the measured period TPOCINTBL is within the range of the predetermined upper limit value and the predetermined lower limit value, then the ok determination counter COKPOC is incremented. However, if the measured period TPOCINTBL is not within the range of the predetermined upper limit value and the predetermined lower limit value, then the NG determination counter CNGPOC is incremented. Thereafter, the answer to step S42 becomes affirmative (YES), and it is determined that the pulsation component having a period which is substantially equal to the period of the drive signal of the purge control valve 19 is not detected, and a no-pulsation determination flag FPTNNOOC is set to "1" (step S43). Subsequently, the pulsation determination end flag FPTNOCEND is set to "1" (step S46). After the pulsation determination end flag FPTNOCEND is set to "1", the answer to step S41 becomes affirmative (YES). Accordingly the process will not be substantially executed.

On the other hand, if the answer to step S44 becomes affirmative (YES), then it is determined that the pulsation component having a period which is substantially equal to the period of the drive signal of the purge control valve 19 is detected, and the no-pulsation determination flag FPTNNOOC is set to "0" (step S45). Subsequently, the process proceeds to step S46 described above.

Figure 9:
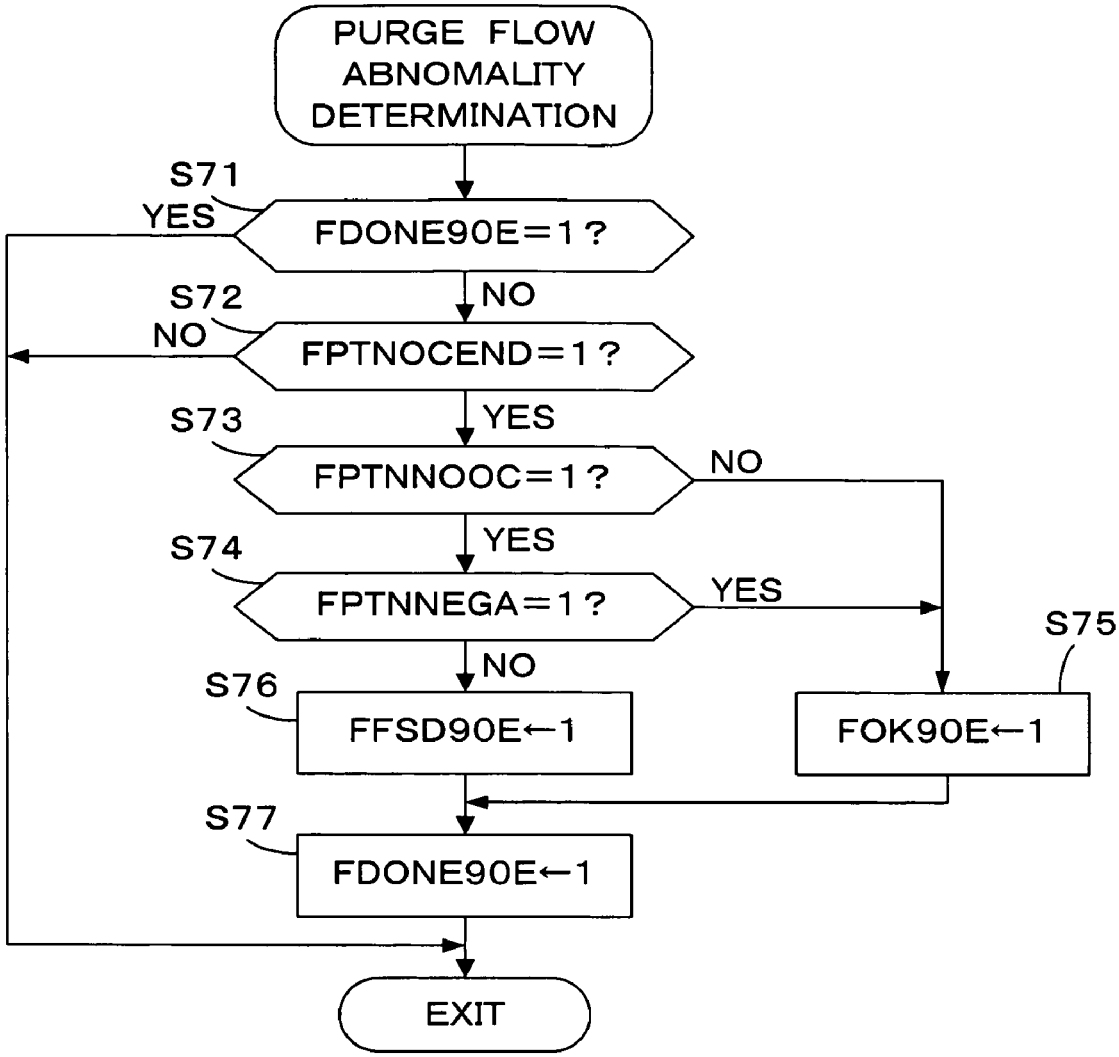
FIG. 9 is a flowchart of a process for determining a purge flow abnormality.

FIG. 9 is a flowchart illustrating a process for determining the purge flow abnormality.

In step S71, it is determined whether or not a purge flow abnormality determination end flag FDONE90E is "1". Since the answer to step S71 is initially negative (NO), the process proceeds to step S72, to determine whether or not the pulsation determination end flag FPTNOCEND is "1". If the answer to step S72 is negative (NO), the process immediately ends.

If the pulsation determination end flag FPTNOCEND becomes "1", the process proceeds to step S73, to determine whether or not the no-pulsation determination flag FPTNNOOC is "1". If the no-pulsation determination flag FPTNNOOC is "1", which indicates that the pulsation component is not detected, it is then further determined whether or not the negative-pressurization flag FPTNNEGA is "1" (step S74). If the answer to step S74 is negative (NO), i.e., if the pulsation component is not detected and the negative-pressurization immediately after starting of the engine is not detected, then it is determined that the purge flow abnormality has occurred, and a purge flow abnormality flag FFSD90E is set to "1" (step S76).

If the answer to step S73 is negative (NO), which indicates that the pulsation component is detected, then it is determined that the purge flow is normal, and a purge flow normal flag FOK90E is set to "1" (step S75). If both of the answers to step S73 and S74 are affirmative (YES), which indicates that the possibility of the open failure of the purge control valve 19 is high. Accordingly, the process proceeds to step S75 without determining that the purge flow is abnormal.

In step S77, the purge flow abnormality determination end flag FDONE90E is set to "1", and the process ends. Thereafter, the answer to step S71 becomes affirmative (YES). Accordingly, this process is not substantially executed.

Figure 10:
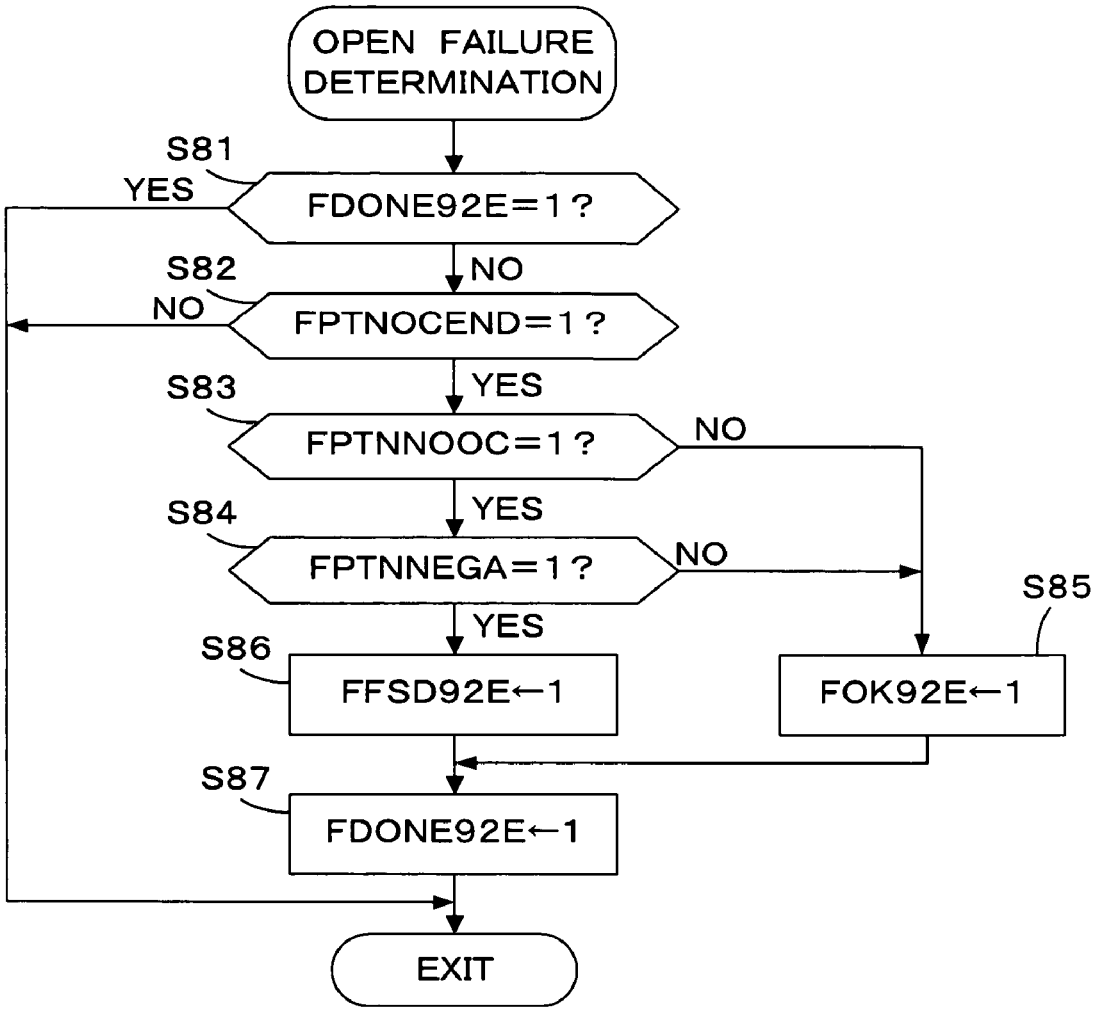
FIG. 10 is a flowchart of a process for determining an open failure of the purge control valve.

FIG. 10 is a flowchart illustrating a process for determining the open failure of the purge control valve 19.

In step S81, it is determined whether or not an open failure determination end flag FDONE92E is "1". Since the answer to step S81 is initially negative (NO), the process proceeds to step S82, to determine whether or not the pulsation determination end flag FPTNOCEND is "1". If the answer to step S82 is negative (NO), then the process immediately ends.

If the pulsation determination end flag FPTNOCEND becomes to "1", the process proceeds to step S83, to determine whether or not the no-pulsation determination flag FPTNNOOC is "1". If the no-pulsation determination flag FPTNNOOC is "1", which indicates that the pulsation component is not detected, then it is further determined whether or not the negative-pressurization flag FPTNNEGA is "1" (step S84). If the answer to step S84 is affirmative, i.e., if the pulsation component is not detected and the negative-pressurization immediately after starting of the engine is detected, then it is determined that the open failure of the purge control valve 19 has occurred, and an open failure flag FFSD92E is set to "1" (step S86).

If the answer to step S83 is negative (NO), i.e., the pulsation component is detected, then it is determined that the open failure has not occurred, and a no open-failure flag FOK92E is set to "1" (step S85). If the answer to step S84 is negative (NO), i.e., the negative-pressurization immediately after starting of the engine is not detected, then the open failure has not occurred. Accordingly, the process proceeds to step S85 as described above.

In step S87, the open failure determination end flag FDONE92E is set to "1", and the process ends. Thereafter, the answer to step S81 becomes affirmative (YES). Accordingly, this process is not substantially executed.

As described above, in this embodiment, the detected tank pressure PTANK is subjected to the first low-pass filtering whose cutoff frequency is comparatively high, in order to calculate the first low-pass filtered pressure PTNKOCAVE. On the other hand, the tank pressure PTANK is subjected to the band-stop filtering and further to the second low-pass filtering whose cutoff frequency is lower than the cutoff frequency of the first low-pass filtering, in order to calculate the second low-pass filtered pressure PTNKAVE. Then, it is determined whether or not the pulsation component having a period which is substantially equal to the drive signal period TD of the purge control valve 19, i.e., the frequency component corresponding to the frequency of the drive signal, is present based on the first low-pass filtered pressure PTNKOCAVE and the second low-pass filtered pressure PTNKAVE. Based on the result of this determination, it is further determined whether or not the purge flow abnormality or the open failure of the purge control valve has occurred. Accordingly, the failure diagnosis can be performed during execution of ordinary evaporative fuel purge, thereby securing execution frequency of the failure diagnosis and performing sufficient purge of the evaporative fuel. In other words, if the negative-pressurization of the evaporative fuel processing system is performed for the failure diagnosis, then it is impossible to carry out the ordinary evaporative fuel purge because the vent shut valve 16 must be closed. Further, the exhaust characteristic or the drivability of the engine may possibly be deteriorated, if an amount of the evaporative fuel to be purged is increased when the failure diagnosis is not being performed. According to the failure diagnosis of this embodiment, such inconvenience can be eliminated.

Further, if the tank pressure PTANK (the second low-pass filtered pressure PTNKAVE) decreases by a value which is equal to or greater than the predetermined amount (|DPTANKNEGA|), immediately after starting of the engine 1 and the pulsation component having a period which is substantially equal to the period of the drive signal of the purge control valve during execution of the evaporative fuel purge, then it is determined that the open failure of the purge control valve 19 is present (FIG. 6, steps S27 and S28, FIG. 10, steps S83 and S84). Therefore, the open failure of the purge control valve 19 can be determined quickly and correctly.

Further, in this embodiment, the evaporative fuel processing system which supplies evaporative fuel to the intake pipe 2 of the engine provided with the turbocharger 5, is shown, and the failure diagnosis in this embodiment can be performed also when performing the evaporative fuel purge during turbocharging (boosting of the intake pressure by the turbocharger 5).

In the process shown in FIG. 6, it is determined whether or not the tank pressure PTANK is negatively-pressurized immediately after starting of the engine 1. Alternatively, as described above with reference to FIG. 5, the process can determine that an open failure has occurred, when an increase amount DPTNKUP of the tank pressure PTANK in a predetermined determination period immediately after stoppage of the engine 1 exceeds a predetermined amount (e.g., |DPTKNEGA|), and the pulsation component having a period which is substantially equal to the period of the drive signal of the purge control valve is not detected during execution of the purge. Further, the purge flow may be determined to be abnormal, when the pulsation component described above is not detected and the increase amount DPTNKUP described above does not exceed the predetermined amount. In this modification, the process of FIG. 6 is modified so that steps S19, S20, S23, and S27-S29 may be omitted. The modified process proceeds to step S21 after execution of step S18, and proceeds to step S30 if the answer to step S22 is affirmative (YES).

In this embodiment, the charge passage 11 corresponds to the first passage, the first purge passage 18 and the second purge passage (20, 23) correspond to the second passage, and the pressure sensor 30 corresponds to the pressure detecting means. The ECU 31 includes the control means, the first filtering means, the second filtering means, the flow rate abnormality determining means, and the open failure determining means. Specifically, step S16 of FIG. 6 corresponds to the first filtering means, steps S17 and S18 correspond to the second filtering means, steps S19, S20, S23, and S27-S29 of FIG. 6 correspond to the open failure determining means, and steps S19-S31 of FIG. 6 and the processes shown in FIG. 7-FIG. 10 correspond to the flow rate abnormality determining means.

The present invention is not limited to the above-described embodiment, but various modifications may be made. For example, in the above embodiment, the purge flow abnormality and the open failure of the purge control valve are separately determined. Alternatively, the purge flow abnormality and the open failure of the purge control valve may together be determined as a flow rate abnormality of the purge gas. In this example, if the pulsation component having a period which is substantially equal to the period of the drive signal of the purge control valve is not detected, it is determined that the flow rate abnormality of the purge gas has occurred. On the other hand, if the pulsation component described above is detected, then the flow rate of the purge gas is determined to be normal. An example of abnormality where the pulsation component as described above is not detected although the purge control valve is normal, is considered to be a state where a large hole is present in the purge passage.

Further, in the above described embodiment, the tank pressure PTANK is subjected to the band-stop filtering and the second low-pass filtering, in order to calculate the second low-pass filtered pressure PTNKAVE. Alternatively, the band-stop filtering may be omitted, and the tank pressure PTANK may be subjected to a low-pass filtering, of which the cutoff characteristic is comparatively steep and the cutoff frequency is substantially equal to the cutoff frequency of the second low-pass filtering.

Further, the present invention can be applied also to the failure diagnosis of the evaporative fuel processing system which includes a fuel tank for supplying fuel to a watercraft propulsion engine, such as an outboard engine having a vertically extending crankshaft.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. A failure diagnosis apparatus for diagnosing a failure within an evaporative fuel processing system which includes a fuel tank, a canister having adsorbent for adsorbing evaporative fuel generated in said fuel tank, an air passage connected to said canister for communicating said canister with the atmosphere, a first passage for connecting said canister and said fuel tank, a second passage for connecting said canister and an intake system of an internal combustion engine, and a purge control valve provided in said second passage, said failure diagnosis apparatus comprising:

pressure detecting means for detecting a pressure in said evaporative fuel processing system;

control means for controlling an opening of said purge control valve by changing a duty ratio of a drive signal which drives said purge control valve;

first filtering means for performing a first filtering of the pressure detected by said pressure detecting means, second filtering means for performing a second filtering of the pressure detected by said pressure detecting means, a second passing frequency band of the second filtering being narrower than a first passing frequency band of the first filtering; and flow rate abnormality determining means for determining a flow rate abnormality of a purge gas flowing in said second passage, based on the filtered pressures outputted from said first and second filtering means.

2. A failure diagnosis apparatus according to claim 1, wherein said flow rate abnormality determining means includes open failure determining means for determining an open failure of said purge control valve based on changes in the pressure detected by said pressure detecting means immediately after said engine starts.

3. A failure diagnosis apparatus according to claim 1, wherein said flow rate abnormality determining means includes open failure determining means for determining an open failure of said purge control valve based on changes in the pressure detected by said pressure detecting means immediately after said engine stops.

4. A failure diagnosis apparatus according to claim 1, wherein the first filtering is a first low-pass filtering and the second filtering is a combination of a band-stop filtering and a second low-pass filtering, wherein the band-stop filtering eliminates a frequency component that corresponds to a frequency of the drive signal of said purge control valve.

5. A failure diagnosis apparatus according to claim 1, wherein said flow rate abnormality determining means determines based on the filtered pressures that the flow rate of the purge is normal if a pulsation component having a period which is substantially equal to a period of the drive signal of said purge control valve is detected in the pressure detected by said pressure detecting means.

6. A failure diagnosis apparatus according to claim 1, wherein said engine is provided with a turbocharger, and said evaporative fuel processing system includes a jet pump for supplying of evaporative fuel to said intake system during boosting of a pressure in said intake system by said turbocharger.

7. A failure diagnosis method for diagnosing a failure of an evaporative fuel processing system which includes a fuel tank, a canister having adsorbent for adsorbing evaporative fuel generated in said fuel tank, an air passage connected to said canister for communicating said canister with the atmosphere, a first passage for connecting said canister and said fuel tank, a second passage for connecting said canister and an intake system of an internal combustion engine, and a purge control valve provided in said second passage, said failure diagnosis method comprising the steps of:

a) detecting a pressure in said evaporative fuel processing system;

b) controlling an opening of said purge control valve by changing a duty ratio of a drive signal which drives said purge control valve;

c) performing a first filtering of the detected pressure, d) performing a second filtering of the detected pressure, a second passing frequency band of the second filtering being narrower than a fierst passing frequency band of the first filtering; and e) determining a flow rate abnormality of a purge gas flowing in said second passage, based on the filtered pressures obtained by filtering of said steps c) and d).

8. A failure diagnosis method according to claim 7, wherein said step e) of determining the flow rate abnormality includes a step of determining an open failure of said purge control valve based on changes in the pressure detected immediately after said engine starts.

9. A failure diagnosis method according to claim 7, wherein said step e) of determining the flow rate abnormality includes a step of determining an open failure of said purge control valve based on changes in the pressure detected immediately after said engine stops.

10. A failure diagnosis method according to claim 7, wherein the first filtering is a first low-pass filtering and the second filtering is a combination of a band-stop filtering and a second low-pass filtering, wherein the band-stop filtering eliminates a frequency component that corresponds to a frequency of the drive signal of said purge control valve.

11. A failure diagnosis method according to claim 7, wherein the flow rate of the purge is determined to be normal based on the filtered pressures if a pulsation component having a period which is substantially equal to a period of the drive signal of said purge control valve is detected in the detected pressure.

12. A failure diagnosis method according to claim 7, wherein said engine is provided with a turbocharger, and said evaporative fuel processing system includes a jet pump for supplying of evaporative fuel to said intake system during boosting of a pressure in said intake system by said turbocharger.

13. A computer program embodied on a computer-readable medium, for causing a computer to carry out a failure diagnosis method for diagnosing a failure of an evaporative fuel processing system which includes a fuel tank, a canister having adsorbent for adsorbing evaporative fuel generated in said fuel tank, an air passage connected to said canister for communicating said canister with the atmosphere, a first passage for connecting said canister and said fuel tank, a second passage for connecting said canister and an intake system of an internal combustion engine, and a purge control valve provided in said second passage, said failure diagnosis method comprising the steps of:

a) detecting a pressure in said evaporative fuel processing system;

b) controlling an opening of said purge control valve by changing a duty ratio of a drive signal which drives said purge control valve;

c) performing a first filtering of the detected pressure, d) performing a second filtering of the detected pressure, a second passing frequency band of the second filtering being narrower than a first passing frequency band of the first filtering; and e) determining a flow rate abnormality of a purge gas flowing in said second passage, based on the filtered pressures obtained by filtering of said steps c) and d).

14. A computer program according to claim 13, wherein said step e) of determining the flow rate abnormality includes a step of determining an open failure of said purge control valve based on changes in the pressure detected immediately after said engine starts.

15. A computer program according to claim 13, wherein said step e) of determining the flow rate abnormality includes a step of determining an open failure of said purge control valve based on changes in the pressure detected immediately after said engine stops.

16. A computer program according to claim 13, wherein the first filtering is a first low-pass filtering and the second filtering is a combination of a band-stop filtering and a second low-pass filtering, wherein the band-stop filtering eliminates a frequency component that corresponds to a frequency of the drive signal of said purge control valve.

17. A computer program according to claim 13, wherein the flow rate of the purge is determined to be normal based on the filtered pressures if a pulsation component having a period which is substantially equal to a period of the drive signal of said purge control valve is detected in the detected pressure.

18. A computer program according to claim 13, wherein said engine is provided with a turbocharger, and said evaporative fuel processing system includes a jet pump for supplying of evaporative fuel to said intake system during boosting of a pressure in said intake system by said turbocharger.

* * * * *